US007815459B2

(12) United States Patent
Chen et al.

(10) Patent No.: US 7,815,459 B2
(45) Date of Patent: Oct. 19, 2010

(54) CABLE CONNECTOR ASSEMBLY HAVING A SPACER AND A BRACKET

(75) Inventors: Hong-Ji Chen, Kunshan (CN); Su-Feng Liu, Kunshan (CN); Chin-Te Lai, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/432,766

(22) Filed: Apr. 30, 2009

(65) Prior Publication Data

US 2009/0275244 A1 Nov. 5, 2009

(30) Foreign Application Priority Data

Apr. 30, 2008 (CN) ..... 2008 2 0035877

(51) Int. Cl.
*H01R 13/627* (2006.01)

(52) U.S. Cl. ..... 439/351

(58) Field of Classification Search ..... 439/351, 439/355, 367, 404, 676
See application file for complete search history.

(56) References Cited

U.S. PATENT DOCUMENTS

| | | | | |
|---|---|---|---|---|
| 6,790,087 | B2 | 9/2004 | Ho | |
| 6,821,149 | B2 * | 11/2004 | Lai | 439/607.31 |
| 6,866,538 | B2 * | 3/2005 | Lee | 439/404 |
| 7,318,741 | B2 * | 1/2008 | Wu | 439/354 |
| 7,568,940 | B2 * | 8/2009 | Cheng et al. | 439/489 |

* cited by examiner

*Primary Examiner*—Chandrika Prasad
(74) *Attorney, Agent, or Firm*—Wei Te Chung; Andrew C. Cheng; Ming Chieh Chang

(57) ABSTRACT

A cable connector assembly (100) comprises: an insulative housing (1) defining a base portion (10) and mating portion (11); a plurality of contacts (2) received in the insulative housing and arranged in a line transversely; a cable (5) connected to the contacts electrically; a cover (6) made by an insulating material and mating with insulative housing; wherein the cover is attached to base portion of the insulative housing, the cover and the mating portion is located at the opposite sides of the base portion, a receiving space is defined by the insulative housing and the cover, one end of the cable and the contacts are received and connected electrically in the receiving space.

6 Claims, 4 Drawing Sheets

CABLE CONNECTOR ASSEMBLY HAVING A SPACER AND A BRACKET

BACKGROUND OF THE INVENTION

1. Field of the Invention

The present invention relates to a cable connector assembly, and more particularly to a cable connector assembly used for high-speed signal transmission.

2. Description of Prior Art

There exists in the art a cable connector assembly known as a Serial Advanced Technology Attachment (Serial ATA) connector which is generally used for such as notebook computer and storage peripherals. Especially, the Serial ATA connectors are featured in fewer counts of electrical contacts than other conventional electrical connectors and are relatively tiny in configuration.

U.S. Pat. No. 7,318,741, for example, discloses such a cable connector assembly, which comprises an insulative housing with a mating portion, a plurality of contacts received in the housing, a cable connected to the contacts electrically, a cover and an insulator. The cover further comprises an upper cover and a lower cover, which are combined by screws. One end of the cable is over-molded by the insulator and received in the cover. Conclusively, the cable connector assembly is formed by so many components, and the assembly procedure and the product structure of the connector will become complex, the cost of the cable connector assembly will be high, accordingly.

Hence, it is desirable to have an improved cable connector assembly to overcome the above-mentioned disadvantages of the prior art.

BRIEF SUMMARY OF THE INVENTION

Accordingly, the object of the present invention is to provide a cable connector assembly with a simple structure and an improved cover to assembly.

In order to achieve the above-mentioned object, a cable connector assembly comprises: an insulative housing defining a base portion and mating portion extending from the base portion; a plurality of contacts received in the insulative housing and arranged in a line transversely; a cable connected to the contacts electrically; a cover made by an insulating material and mating with insulative housing; wherein the cover is attached to the base portion of the insulative housing, the cover and the mating portion is located at the opposite sides of the base portion, a receiving space is defined by the insulative housing and the cover, one end of the cable and the contacts are received and connected electrically in the receiving space.

Other objects, advantages and novel features of the invention will become more apparent from the following detailed description of the present embodiment when taken in conjunction with the accompanying drawings.

DETAILED DESCRIPTION OF THE INVENTION

Figure 1:
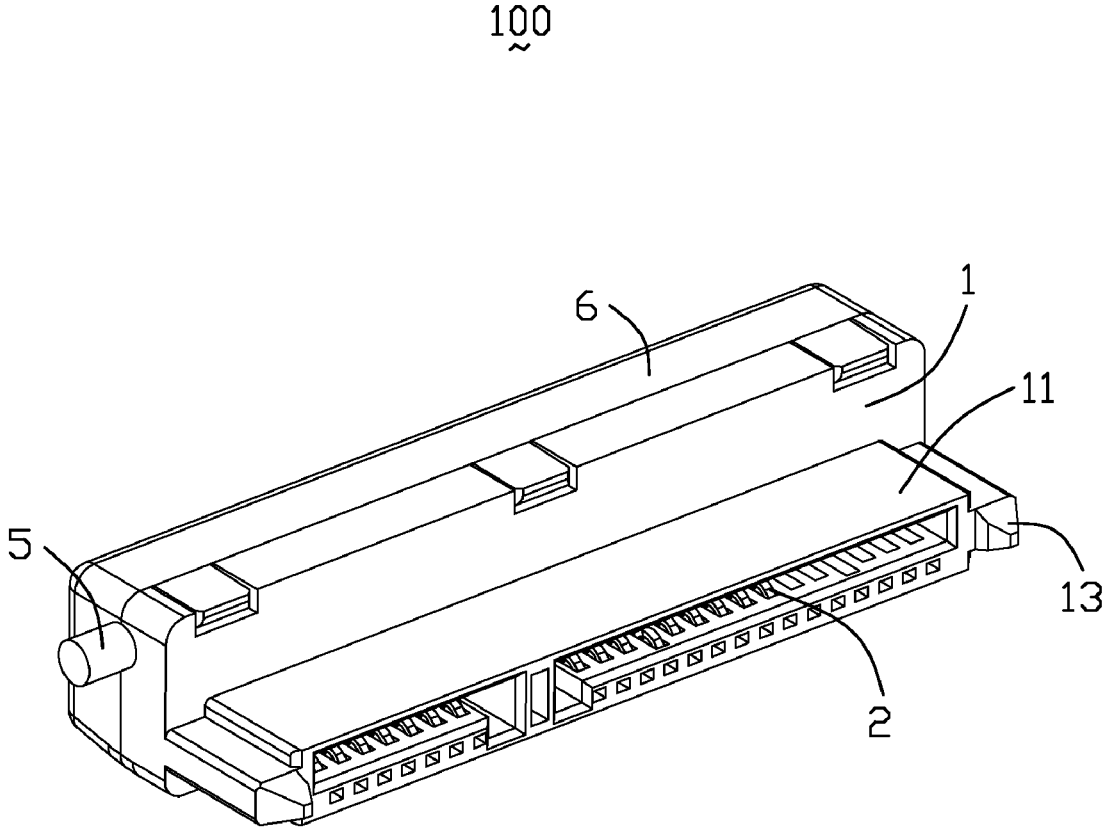
FIG. 1 is a perspective view of a cable connector assembly in accordance with the present invention.

Reference will now be made to the drawing figures to describe the present invention in detail.

Referring to FIG. 1 to FIG. 4, a cable connector assembly 100 comprises an insulative housing 1, a plurality of contacts 2 received in the housing 1, a spacer 3 separating the contacts 2, a bracket 4 held on the housing 1, a cable 5 connected to the contacts 2 and a cover 6 engaging with the housing 1.

The insulative housing 1 comprises an elongated base portion 10, a mating portion 11 extending from one side of the base portion 10 and a pair of guiding post 13 disposed at the opposite sides of the mating portion 11. The base portion 11 forms a plurality of step portions 101 on the top surface and bottom surface thereof, and one side of the base portion 11 comprises a half hole 102 for receiving the cable 5. The half hole 102 has a tuber 103 therein for clipping the cable 5. The base portion 11 further comprises a retaining groove 104 which assumes an H-shaped. The elongated mating portion 11 comprises a plurality of passageway 111 for receiving the contacts 2 and a receiving room 110 for receiving a butting connector (not shown), and the passageways 111 are arranged in a line transversely and thread through the mating portion 11 and the base portion 10. The insulative housing 1 further comprises a pair of retaining groove 112 located at the opposite sides of the passageway 111 and extend in a vertical direction.

Figure 2:
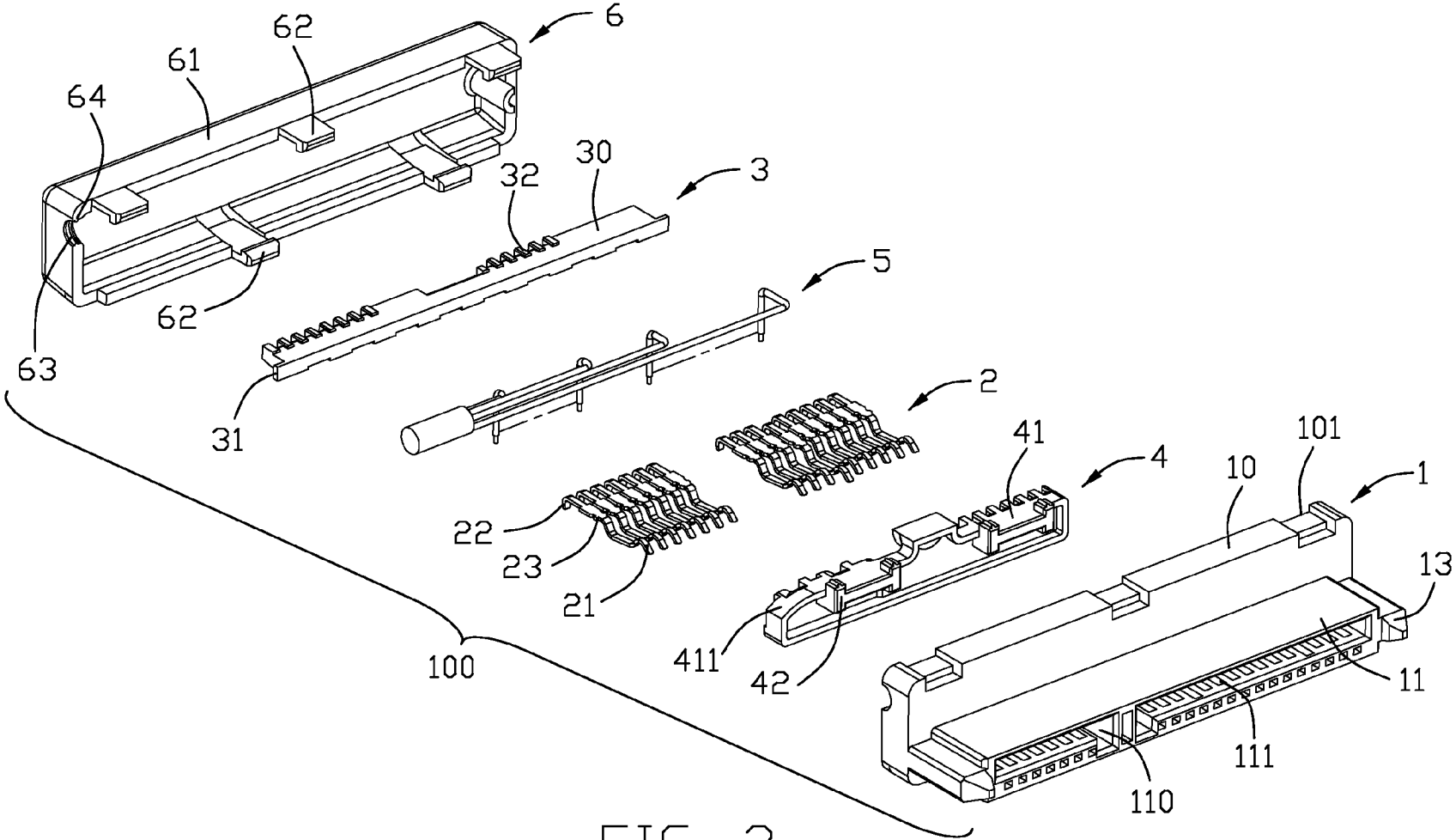
FIG. 2 is an exploded, perspective view of the cable connector assembly shown in FIG. 1.
Figure 3:
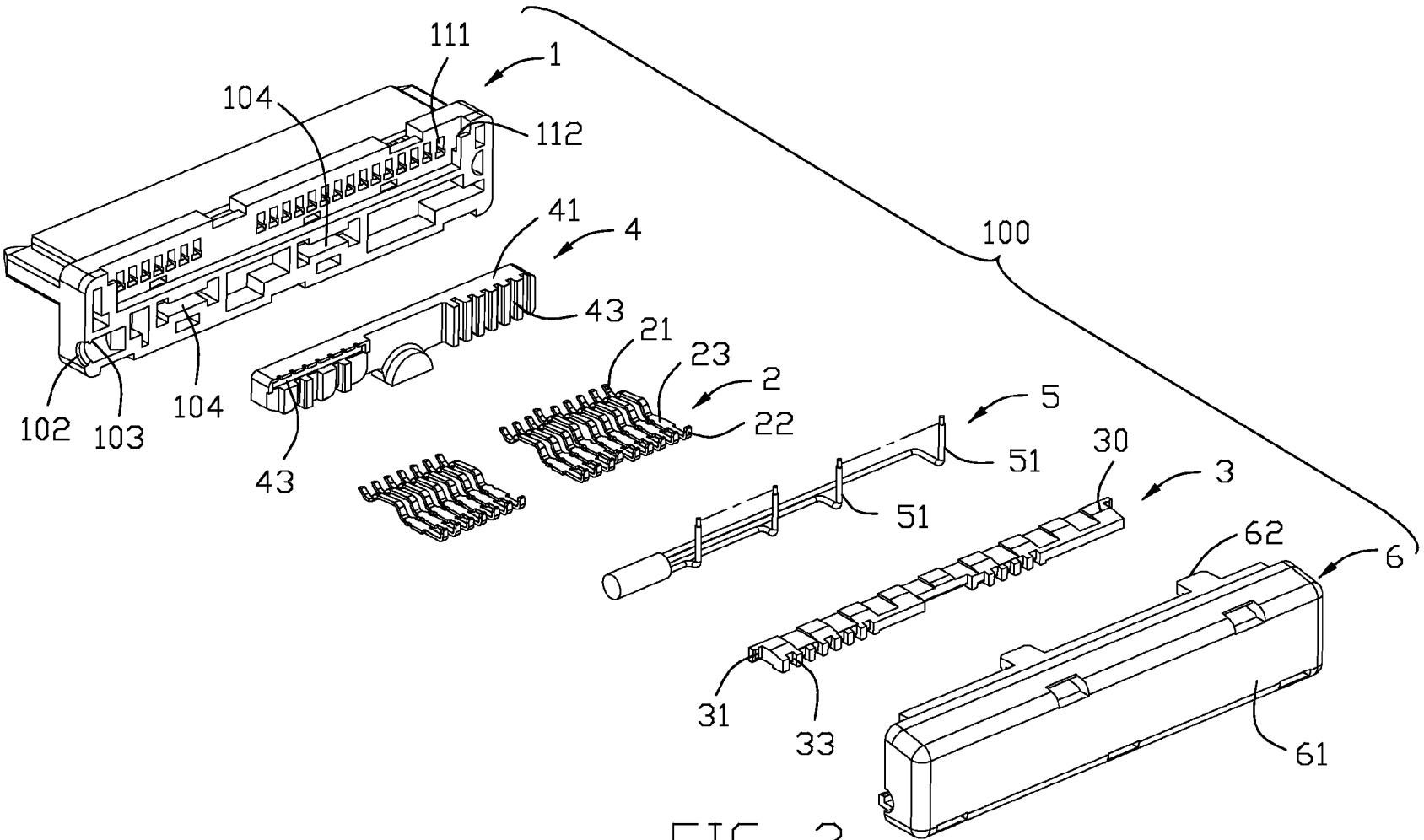
FIG. 3 is a view similar to the FIG. 2, but taken from other aspect.

Referring to FIG. 1 to FIG. 3, the cover 6 is hollow and assumes a cap-shaped, which is disposed at the front portion of the cable connector assembly 100. The cover 6 is attached to the insulative housing 1 in a front-to-back direction to form a receiving space (not labeled), and the bracket 4, one end of the cable 5 and the contacts 2 are all received in the receiving space, that leads to the outline of cable assembly connector 100 formed just by the cover 6 and the insulative housing 1. The cover 6 is made by an insulative material and comprises a shielding portion 61 and a plurality of latches 62 extending backwardly from the shielding portion 61. The latches 62 engage with the step portions 101 of the insulative housing 1, which are embedded by the base portion 10 to prevent the cover moving in a right-to-left direction. The cover 6 further comprises another half hole 63 corresponding with the half hole 102 of the insulative housing 1, and they have the same structure and size to form a full hole.

Referring to FIG. 1 to FIG. 4, the contacts 2 are received in the passageway 111 of the insulative housing 1, and each contact comprises a contacting portion 21, a tail portion 22 and a connecting portion 23. The contacting portion 21 extends into the receiving room 110. The connecting portion 23 connects the tail portion 22 and the contacting portion 21 and is held by the insulative housing 1. The tail portion 22 extends into the receiving space (not labeled).

Figure 4:
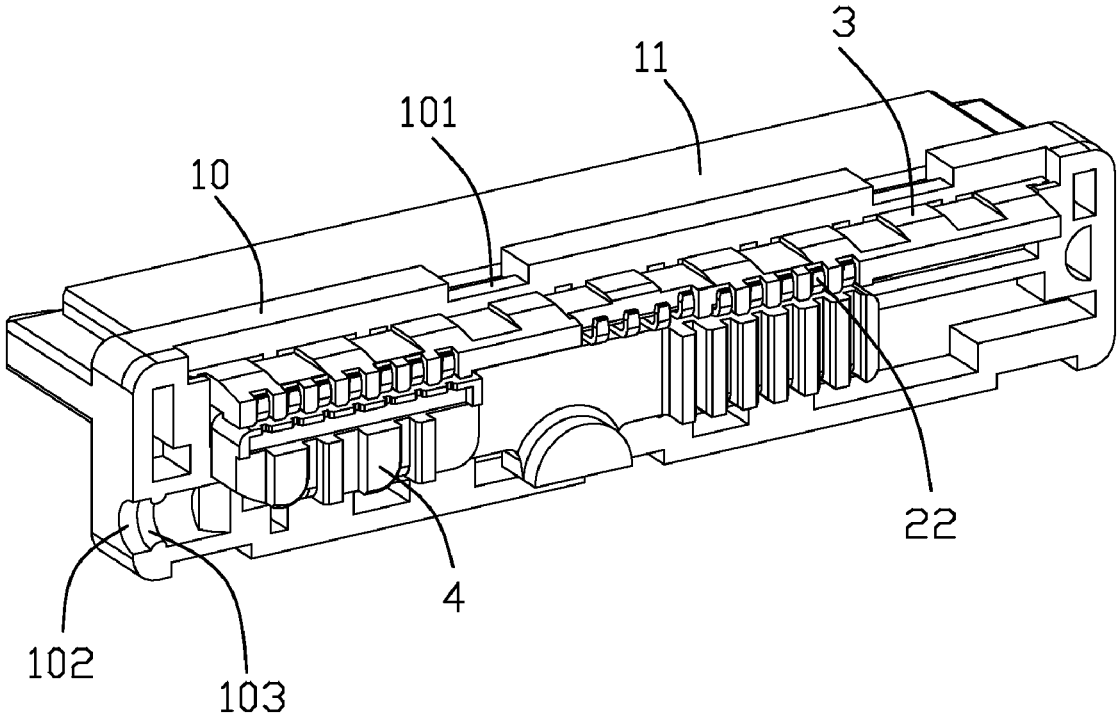
FIG. 4 is a perspective view of the cable connector assembly without cover shown in FIG. 1.

Referring to FIG. 2 to FIG. 4, the spacer 3 is attached to the insulative housing 1 and located between the tail portion 22 of the contact 2 and the base portion 10 of the insulative housing 1, and it comprises a main portion 30, a pair of guiding portions 31 located at the opposite sides of the main portion 30 and a spacing portion 32 located at the front edge of the main portion 30. The guiding portion 31 is inserted into the retaining groove 112 in the vertical direction. The spacing portion 32 has a plurality of gaps 33 for receiving the tail portion 22 of the contact 2.

Referring to FIG. 1 to FIG. 3, the cable 5 extends out of the cable connector assembly 100 through the hole formed by the half hole 63 of the cover 6 and the half hole 102 of the insulative housing 1. The cable 5 comprises a plurality of core wires 51 connecting with the tail portion 22 of the contact 2 electrically. The cable 5 is clipped by the tuber 103 to prevent the cable being pulled out of the cable connector 100 easily.

Referring to FIG. 2 to FIG. 4, the bracket 4 is mounted to receiving space for separating the core wires 51, and it comprises a base 41, a holding member 42 located at the rear portion of the base 41 and a plurality of barriers 43 located at the front portion of the base 41 to form unlabeled corresponding passages each between every adjacent two barriers. The base 41, next to the hole (not labeled), forms an arc surface 411 to prevent the cable 5 being broken. The passages beside the barriers 43 is used to receive the core wires 51 and correspond to the gaps 32 of the spacer 3. The holding member 42 assumes an H-shaped for mating with the H-shaped retaining groove 104 of the insulative housing 1.

The assembly procedure of the cable connector assembly 100 as follows: the contacts 2 are inserted into the passageway 111 and retained by the insulative housing 1, the guiding portion 32 of the spacer 3 is inserted into the retaining groove 112, the tail portion 22 of the contact 2 is received in the gap 33 of the spacer, the bracket 4 engages with insulative housing 1 by the H-shaped holding member 42, the core wires 51 are soldered to the tail portion 22, and the cover 6 is attached to the insulative housing 1 to finish the assembly procedure.

It is obvious that the components of cable connector assembly 100 are much fewer, the cover 6 of the connector 100 can engage with housing 1 without other component for dismounting conveniently, and the cable 5 is soldered to the contact 2 directly in the receiving space formed by insulative housing 1 and cover 6 to reduce the assembly procedure, for example, the over-molding method.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A cable connector assembly comprises:

an insulative housing defining a base portion;

a plurality of contacts received in the insulative housing;

a cover attached to the base portion of the insulative housing;

a cable connected to the contacts electrically;

the cover being hollow and assuming a cap-shaped, and the cover and the insulative housing forming a receiving space, one end of the cable and the contacts being received and connected electrically in the receiving space; and a spacer and a bracket disposed in the receiving space;

wherein one lateral side of the cable connector assembly comprises a hole, and the cable extends out of the receiving space through the hole.

2. The cable connector assembly as claimed in claim 1, wherein the base portion of the insulative housing comprises step portions, and cover comprises a plurality of latches for engaging with the step portions, which are embedded by the base portion.

3. The cable connector assembly as claimed in claim 1, wherein the spacer forms a plurality of gaps for receiving tail portions of the contacts, and the bracket forms a plurality of barriers corresponding to the gaps of the spacer.

4. A cable connector assembly comprising:

an insulative housing defining an L-shaped cross-section in a side view and a mating port in a front portion thereof;

a plurality of passageways formed in the housing;

a plurality of contacts disposed in the corresponding passageways, respectively, each of said contacts defining a mating section exposed in the mating port, and a tail section opposite to the mating section in a front-to-back direction, the tail section essentially extending in a vertical direction perpendicular to said front-to-back direction and received in a corresponding gap behind the housing;

a bracket located behind the housing and defining a plurality of passages in alignment with the corresponding gaps, respectively, in the vertical direction;

an insulative spacer located behind the housing; and a plurality of wires received in the corresponding passages with inner conductors extending into the corresponding gaps to be electrically and mechanically connected to the corresponding tail sections, respectively;

wherein said spacer and said bracket are spaced from each other by said contacts in said vertical direction.

5. The electrical connector as claimed in claim 4, wherein said gaps are formed in said insulative spacer.

6. The electrical connector as claimed in claim 5, wherein in each of said contacts, the corresponding mating section and the corresponding tail section are isolated from each other by said spacer in said front-to-back direction.

* * * * *